US006799435B2

(12) United States Patent
Saito et al.

(10) Patent No.: US 6,799,435 B2
(45) Date of Patent: Oct. 5, 2004

(54) VAPOR COMPRESSION REFRIGERATION SYSTEM

(75) Inventors: Mika Saito, Kariya (JP); Hirotsugu Takeuchi, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/660,220

(22) Filed: Sep. 11, 2003

(65) Prior Publication Data

US 2004/0052656 A1 Mar. 18, 2004

(30) Foreign Application Priority Data

Sep. 12, 2002 (JP) ..... 2002-266944

(51) Int. Cl.[7] ..... F25B 1/06

(52) U.S. Cl. ..... 62/500; 62/170; 62/512; 417/77

(58) Field of Search ..... 62/500, 512, 170, 62/503, 498, 116, 191; 417/77, 87, 151

(56) References Cited

U.S. PATENT DOCUMENTS 6,438,993 B2 * 8/2002 Takeuchi et al. ..... 62/500
6,606,873 B2 * 8/2003 Takeuchi ..... 62/191
6,698,235 B2 * 3/2004 Nobuta et al. ..... 62/509
6,742,356 B2 * 6/2004 Saito et al. ..... 62/500
2001/0025499 A1 * 10/2001 Takeuchi et al. ..... 62/175
2002/0124592 A1 * 9/2002 Takeuchi et al. ..... 62/500
2003/0209030 A1 * 11/2003 Nishida et al. ..... 62/500
2003/0209032 A1 * 11/2003 Ohta ..... 62/500
2004/0055326 A1 * 3/2004 Ikegami et al. ..... 62/500
2004/0069011 A1 * 4/2004 Nishida et al. ..... 62/500
2004/0089019 A1 * 5/2004 Kawamura et al. ..... 62/500
2004/0103685 A1 * 6/2004 Yamaguchi et al. ..... 62/500

FOREIGN PATENT DOCUMENTS

JP 5-149652 6/1993

* cited by examiner

*Primary Examiner*—Marc Norman
(74) *Attorney, Agent, or Firm*—Harness, Dickey & Pierce, PLC

(57) ABSTRACT

In a vapor compression refrigeration system, an evaporator and a gas-liquid separator are received in a common casing, so that the gas-liquid separator and the evaporator are placed close to each other. Thus, it is possible to limit heat absorption of the liquid phase refrigerant from the atmosphere to reduce the heat loss upon discharge of the refrigerant from the gas-liquid separator. Also, it is possible to reduce pressure loss in a refrigerant passage between the gas-liquid separator and the evaporator.

9 Claims, 4 Drawing Sheets

VAPOR COMPRESSION REFRIGERATION SYSTEM

CROSS REFERENCE TO RELATED APPLICATION

This application is based on and incorporates herein by reference Japanese Patent Application No. 2002-266944 filed on Sep. 12, 2002.

BACKGROUND OF THE INVENTION

1. Field of the Invention

The present invention relates to a vapor compression refrigeration system and more particularly to an ejector cycle, which uses an ejector as a depressurizing means.

2. Description of Related Art

As is known in the art, an ejector cycle is one type of vapor compression refrigeration system, in which refrigerant is depressurized and is expanded by an ejector to draw vaporized refrigerant from an evaporator, and the expansion energy of the refrigerant is converted into corresponding pressure energy to increase intake pressure of a compressor. One such an ejector cycle is disclosed in, for example, Japanese Unexamined Patent Publication No. 5-149652.

As is disclosed in Japanese Unexamined Patent Publication No. 5-149652, liquid phase refrigerant, which is separated by a gas-liquid separator, is circulated to the evaporator, which serves as a low pressure side heat exchanger, through pumping action of the ejector (see JIS Z8126 Number 2.1.2.3). However, a portion of the liquid phase refrigerant outputted from the gas-liquid separator can absorb heat from the surrounding atmosphere, in which a refrigerant pipe for conducting the refrigerant from the gas-liquid separator to the evaporator is placed, so that the portion of the liquid phase refrigerant can be vaporized before entering into the evaporator.

When the refrigerant (two phase refrigerant), which is separated into two phases, i.e., the vapor phase and the liquid phase, is supplied to the evaporator, the amount of refrigerant evaporated in the evaporator is reduced in comparison to the refrigerant, which is entirely in the liquid phase. Thus, heat loss, such as a reduction in the refrigeration capacity (heat absorbing capacity) of the evaporator, occurs.

Furthermore, the density of the liquid phase refrigerant and the density of the vapor phase refrigerant are substantially different from one another. Thus, in the evaporator, a flow path of the vapor phase refrigerant and a flow path of the liquid phase refrigerant are substantially separated from one another. As a result, in the evaporator, one location may have a relatively high vapor phase refrigerant content, and another location may have a relatively high liquid phase refrigerant content.

Thus, the refrigeration capacity may vary from place to place in the evaporator. As a result, the surface temperature may vary from place to place in the evaporator. This results in inappropriate temperature distribution.

SUMMARY OF THE INVENTION

The present invention addresses the above disadvantages. Thus, it is an objective of the present invention to provide a novel vapor compression refrigeration system. It is another objective of the present invention to reduce heat loss in a low pressure side of a vapor compression refrigeration system.

To achieve the objectives of the present invention, there is provided a vapor compression refrigeration system that transfers heat from a low temperature side to a high temperature side. The vapor compression refrigeration system includes a compressor, a high pressure side heat exchanger, a low pressure side heat exchanger, an ejector and a gas-liquid separating means. The compressor draws and compresses refrigerant. The high pressure side heat exchanger releases heat from high pressure refrigerant discharged from the compressor. The low pressure side heat exchanger vaporizes low pressure refrigerant. The ejector increases intake pressure of the compressor and includes a nozzle arrangement and a pressurizer arrangement. The nozzle arrangement depressurizes and expands high pressure refrigerant supplied from the high pressure side heat exchanger. The pressurizer arrangement draws vapor phase refrigerant, which is vaporized in the low pressure side heat exchanger, through use of high speed refrigerant flow discharged from the nozzle arrangement and converts expansion energy of the refrigerant discharged from the nozzle arrangement into pressure energy. The gas-liquid separating means is for separating the refrigerant discharged from the ejector into vapor phase refrigerant and liquid phase refrigerant. The gas-liquid separating means has a vapor phase refrigerant outlet for outputting the vapor phase refrigerant and a liquid phase refrigerant outlet for outputting the liquid phase refrigerant, and the vapor phase refrigerant outlet and the liquid phase refrigerant outlet of the gas-liquid separating means are connected to a refrigerant inlet of the compressor and a refrigerant inlet of the low pressure side heat exchanger, respectively. At least the gas-liquid separating means and the low pressure side heat exchanger are arranged in a common casing.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION (First Embodiment)

Figure 1A:
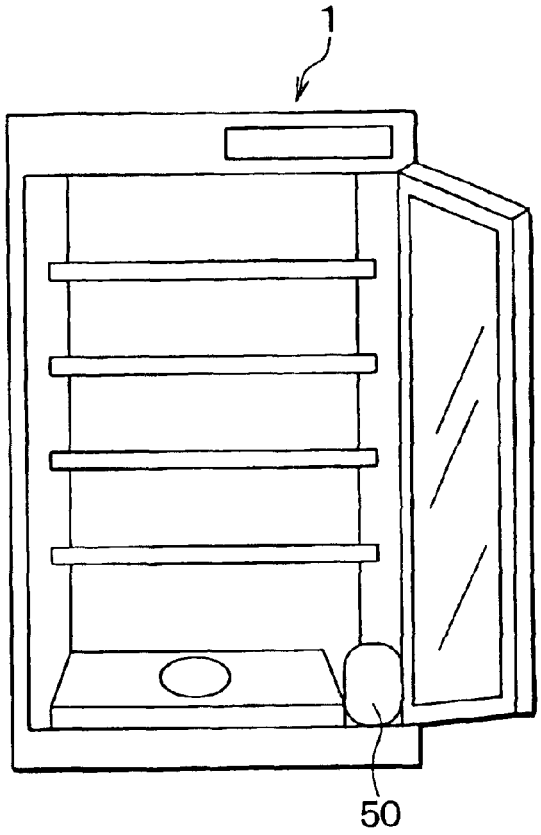
FIG. 1A is a front view of a showcase, into which a gas-liquid separator according to a first embodiment of the present invention is installed.

A vapor compression refrigeration system (also referred to as an ejector cycle) according to a first embodiment of the present invention is applied to a showcase 1 of FIG. 1A, which stores food under refrigeration.

Figure 1B:
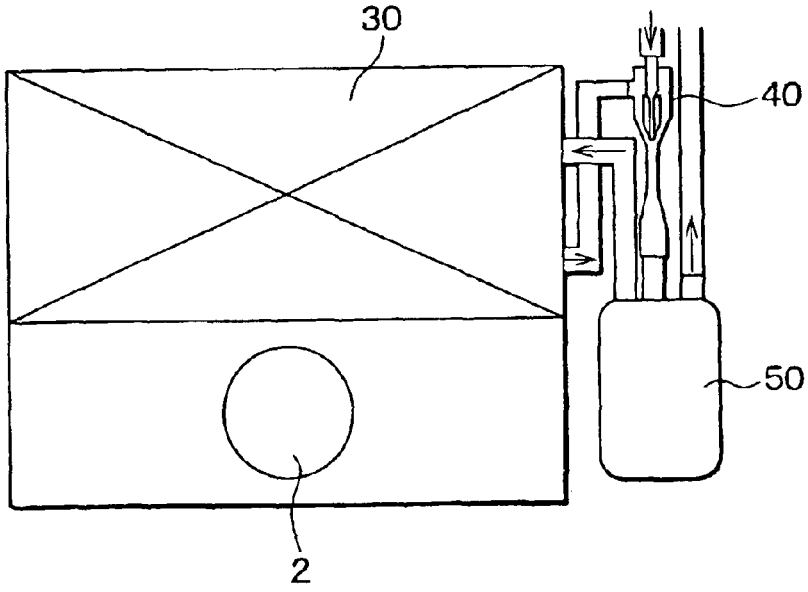
FIG. 1B is a top view of a bottom part of the showcase of FIG. 1A.

With reference to FIGS. 1A and 1B, an evaporator 30 and a blower 2 are arranged at the bottom of the showcase 1. The blower 2 is a centrifugal blower, which draws internal air of the showcase 1 from its front side in FIG. 1A and discharges the drawn air upwardly in FIG. 1A, i.e., discharges the drawn air toward the evaporator 30 arranged in the bottom backside of the showcase 1.

Figure 2:
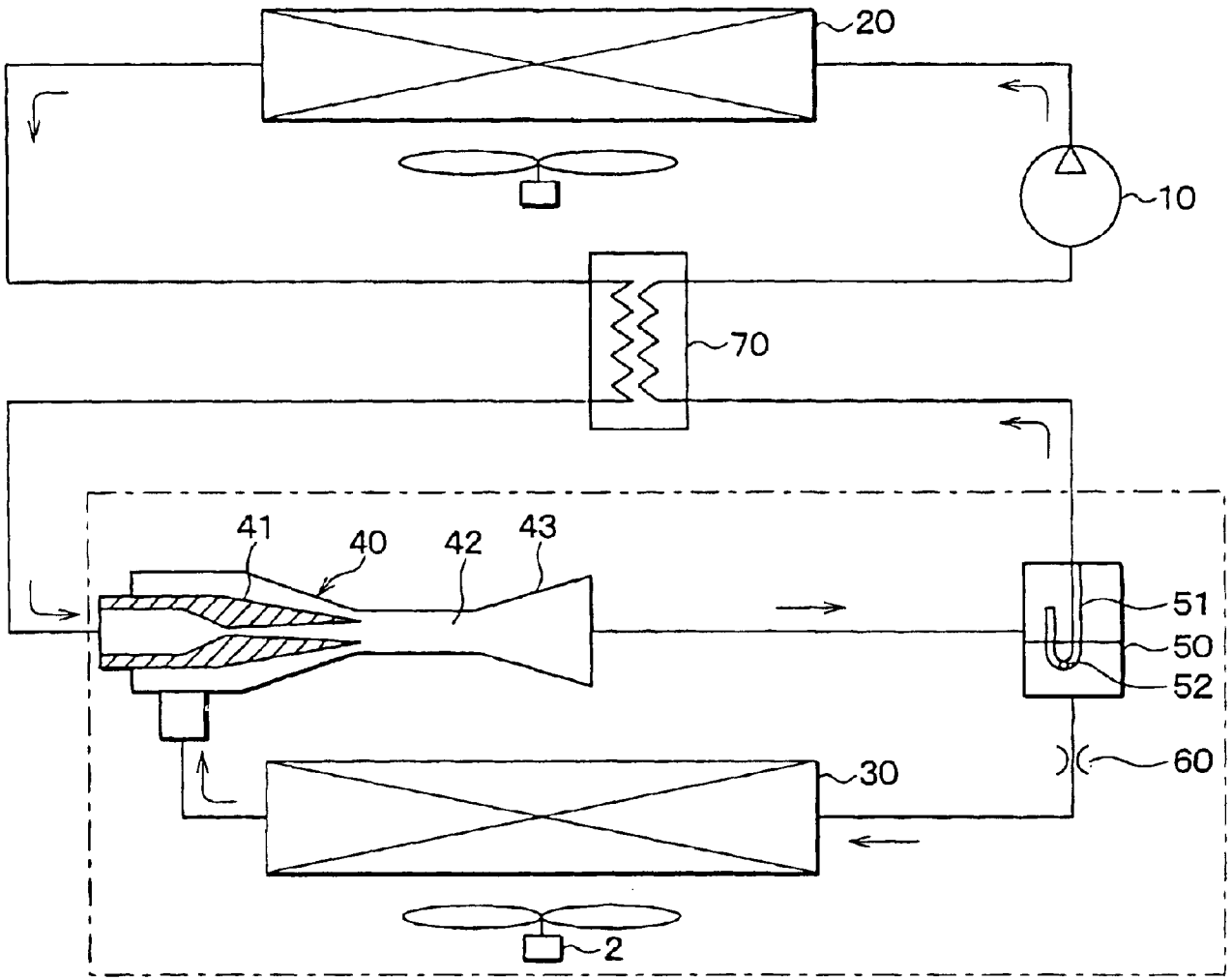
FIG. 2 is a schematic view of an ejector cycle according to the first embodiment.

With reference to FIG. 2, a compressor 10 is an electric compressor, which draws and compresses refrigerant, and a radiator 20 is a high pressure side heat exchanger, which exchanges heat between the hot high pressure refrigerant discharged from the compressor 10 and air to cool the refrigerant.

In the present embodiment, chlorofluorocarbon is used as the refrigerant, so that the refrigerant pressure at the high pressure side is kept below the critical pressure of the refrigerant, and the refrigerant is condensed in the radiator 20.

Furthermore, the evaporator 30 is a low pressure side heat exchanger, which exchanges heat between the liquid phase refrigerant and the air to be discharged into the interior of the showcase 1 to evaporate the liquid phase refrigerant, thereby performing refrigeration. The air, which is cooled by the evaporator 30, is conducted through a duct placed in the backside of the showcase 1 and is discharged into the interior of the showcase 1 at the top side of the showcase 1.

An ejector 40 depressurizes and expands the refrigerant supplied from the radiator 20 to draw the vapor phase refrigerant, which has been vaporized in the evaporator 30. Also, the ejector 40 converts expansion energy of the refrigerant into pressure energy of the refrigerant to increase the intake pressure of the compressor 10.

The ejector 40 includes a nozzle arrangement 41, a mixer arrangement 42 and a diffuser arrangement 43. The nozzle arrangement 41 converts the pressure energy of the high pressure refrigerant supplied from the radiator 20 into the velocity energy in such a manner that the refrigerant is isentropically depressurized and is expanded by the nozzle arrangement 41. In the mixer arrangement 42, high speed refrigerant flow (also referred to as drive refrigerant flow) discharged from the nozzle arrangement 41 draws the vapor phase refrigerant, which has been vaporized in the evaporator 30, and this vapor phase refrigerant is mixed with the refrigerant flow discharged from the nozzle arrangement 41. In the diffuser arrangement 43, the refrigerant discharged from the nozzle arrangement 41 and the refrigerant drawn from the evaporator 30 are further mixed in such a manner that the velocity energy of the refrigerant is converted into the pressure energy to increase the pressure of the mixed refrigerant discharged from the diffuser arrangement 43.

At this time, in the mixer arrangement 42, the drive refrigerant flow discharged from the nozzle arrangement 41 and the drawn refrigerant flow drawn from the evaporator 30 are mixed in such a manner that the sum of the kinetic momentum of the drive refrigerant flow and the kinetic momentum of the drawn refrigerant flow is conserved. Thus, even in the mixer arrangement 42, the pressure (static pressure) of the refrigerant is increased.

In the diffuser arrangement 43, a passage cross sectional size is linearly increased toward the downstream end of the diffuser arrangement 43 to convert the velocity energy (the dynamic pressure) of the refrigerant into the corresponding pressure energy (static pressure). Thus, in the ejector 40, the refrigerant pressure is increased through both the mixer arrangement 42 and the diffuser arrangement 43. Therefore, the mixer arrangement 42 and the diffuser arrangement 43 are collectively referred to as a pressurizer arrangement.

In the present embodiment, the nozzle arrangement 41 is a Laval nozzle arrangement, which has a throttle opening that has the minimum cross sectional area in its passage to accelerate the velocity of the refrigerant discharged from the nozzle arrangement 41 to a level equal to or greater than the sonic velocity. However, it should be understood that a tapered nozzle arrangement, which is tapered toward a distal end, can be used in place of the Laval nozzle arrangement.

The refrigerant discharged from the ejector 40 is supplied to a gas-liquid separator 50. The gas-liquid separator 50 serves as a gas-liquid separating means for separating and storing the supplied refrigerant in two phases, i.e., the vapor phase refrigerant and the liquid phase refrigerant. A vapor phase refrigerant outlet of the gas-liquid separator 50 is connected to a refrigerant inlet of the compressor 10, and a liquid phase refrigerant outlet of the gas-liquid separator 50 is connected to a refrigerant inlet of the evaporator 30.

A J-shaped pipe 51 is received in the gas-liquid separator 50 to extract the vapor phase refrigerant. At the bottom of the J-shaped pipe 51, an oil return hole 52 is provided to return refrigerant oil, which is separated in the gas-liquid separator 50, to the inlet of the compressor 10.

A restrictor 60 is a depressurizing means for depressurizing the liquid phase refrigerant discharged from the gas-liquid separator 50. An internal heat exchanger 70 is a heat exchanger, which exchanges heat between the high pressure refrigerant discharged from the radiator 20 and the low pressure refrigerant to be drawn into the compressor 10.

In the present embodiment, a restrictor of a fixed opening size, such as an orifice or a capillary tube, is used as the restrictor 60. However, the present invention is not limited to this. For example, alternative to the restrictor of the fixed opening size, a thermal expansion valve can be used as the restrictor 60. A size of an opening of the thermal expansion valve is varied to keep a predetermined temperature of the refrigerant at the refrigerant outlet of the evaporator 30.

Figure 3:
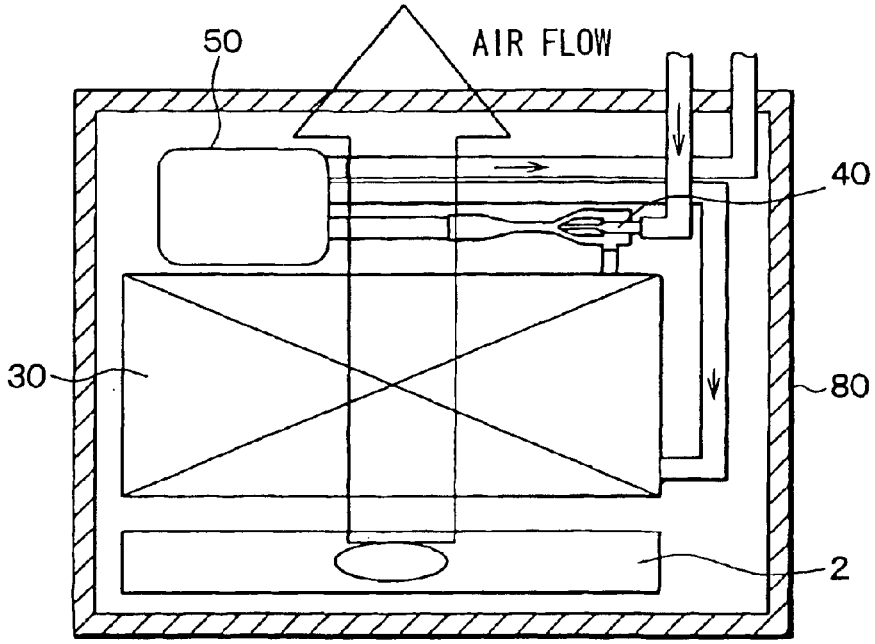
FIG. 3 is a schematic view of a cooling unit according to the first embodiment.

In the present embodiment, the evaporator 30, the ejector 40, the gas-liquid separator 50 and the blower 2, which are enclosed in a rectangular of a dot-dash line in FIG. 2, are received in a common casing 80 and constitute a cooling unit, as shown in FIG. 3.

Desirably, the casing 80 has a heat insulating structure or is made of a heat insulating material to thermally isolate the evaporator 30, the ejector 40 and the gas-liquid separator 50 from the atmosphere (particularly, the external air located outside the showcase 1).

Furthermore, the ejector 40 and the gas-liquid separator 50 are placed in an air flow generated by the blower 2 at a location downstream of the evaporator 30 in the air flow.

In designing of the ejector cycle, the pressure loss, which occurs in the refrigerant passage from the refrigerant outlet of the ejector 40 to the refrigerant inlet of the ejector 40 through the gas-liquid separator 50 and the evaporator 30, should be set to a level smaller than the amount of pressure increase in the pressurizer arrangement (ejector 40).

Next, operation of the ejector cycle will be described.

When the compressor 10 is activated, the vapor phase refrigerant of the gas-liquid separator 50 is drawn into the compressor 10, and the compressed refrigerant is discharged from the compressor 10 to the radiator 20. Then, the refrigerant, which is cooled by the radiator 20, is depressurized and is expanded by the nozzle arrangement 41 of the ejector 40 to draw the refrigerant of the evaporator 30.

Then, the refrigerant drawn from the evaporator 30 and the refrigerant discharged from the nozzle arrangement 41 are mixed in the mixer arrangement 42, and the dynamic pressure of the refrigerant is converted by the diffuser arrangement 43 into the corresponding static pressure. Thereafter, the refrigerant is returned to the gas-liquid separator 50.

Since the refrigerant of the evaporator 30 is drawn by the ejector 40, the liquid phase refrigerant is supplied from the gas-liquid separator 50 to the evaporator 30. Then, this liquid phase refrigerant absorbs heat from the air to be discharged into the interior of the showcase 1 and is thus vaporized. In the present embodiment, the ejector cycle is operated to keep the temperature of the interior of the evaporator 30 equal to or below zero degrees Celsius.

Next, advantages of the present embodiment will be described.

In the present embodiment, the evaporator 30 and the gas-liquid separator 50 are received in the same casing (i.e., the common casing) 80, so that the gas-liquid separator 50 and the evaporator 30 are placed close to each other. Thus, it is possible to limit heat absorption of the liquid phase refrigerant from the atmosphere to reduce the heat loss upon discharge of the refrigerant from the gas-liquid separator 50. Also, it is possible to reduce pressure loss in the refrigerant passage between the gas-liquid separator 50 and the evaporator 30.

Similarly, the evaporator 30 and at least a portion of the ejector 40 are received in the same casing 80, so that the ejector 40 and the evaporator 30 are placed close to each other. Thus, it is possible to limit heat absorption of the vapor phase refrigerant from the atmosphere upon discharge of the refrigerant from the evaporator 30.

Therefore, it is possible to reduce heat loss in the refrigerant passage between the evaporator 30 and the ejector 40. Thus, it is possible to restrain an increase in the temperature of the refrigerant to be supplied to the gas-liquid separator 50, and also it is possible to reduce the pressure loss in the refrigerant passage between the evaporator 30 and the ejector 40.

As a result, the heat loss and the pressure loss of the entire ejector cycle can be advantageously reduced, so that the coefficient of performance of the ejector cycle can be improved, and the compact ejector cycle can be provided.

The ejector 40 and the gas-liquid separator 50 (particularly, the gas-liquid separator 50) have the temperature lower than that of the atmosphere. Thus, as in the present embodiment, when the ejector 40 and the gas-liquid separator 50 are placed in the air flow generated by the blower 2, the air to be blown into the interior of the showcase 1 can be cooled not only by the evaporator 30 but also by the ejector 40 and the gas-liquid separator 50.

In the present embodiment, the ejector 40 and the gas-liquid separator 50 are arranged downstream of the evaporator 30 in the air flow to supply a relatively large amount of air to the evaporator 30, which has a relatively high heat exchange efficiency for exchanging heat with the air.

(Second Embodiment)

Figure 4A:
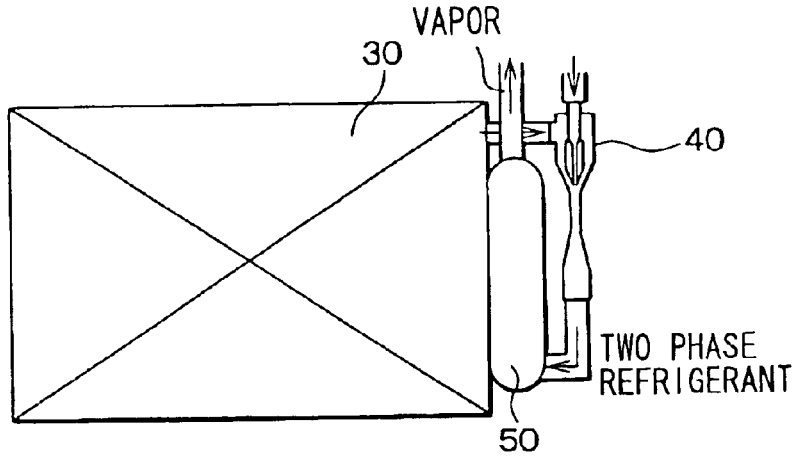
FIG. 4A is a schematic frontal view of a cooling unit according to a second embodiment of the present invention.
Figure 4B:
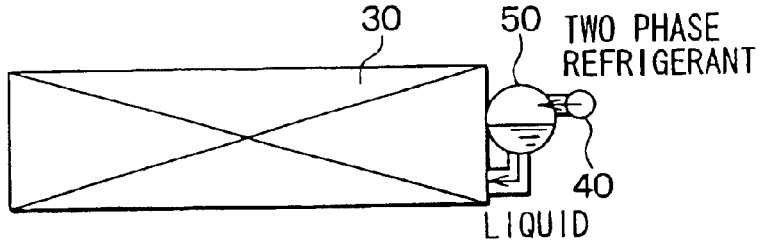
FIG. 4B is a schematic top view of the cooling unit of the second embodiment.

In a second embodiment of the present invention, as shown in FIG. 4, the evaporator 30, the ejector 40 and the gas-liquid separator 50 are integrated together.

Here, the integration of the evaporator 30, the ejector 40 and the gas-liquid separator 50 means integration of the evaporator 30, the ejector 40 and the gas-liquid separator 50 by, for example, brazing, integral press work or screwing in a manufacturing process at a manufacturer to disallow an end user to easily disassemble the evaporator 30, the ejector 40 and the gas-liquid separator 50 from one another.

(Modifications)

In the above embodiments, the restrictor 60 is provided. However, the present invention is not limited to this, and the restrictor 60 can be eliminated, if appropriate.

Figure 5:
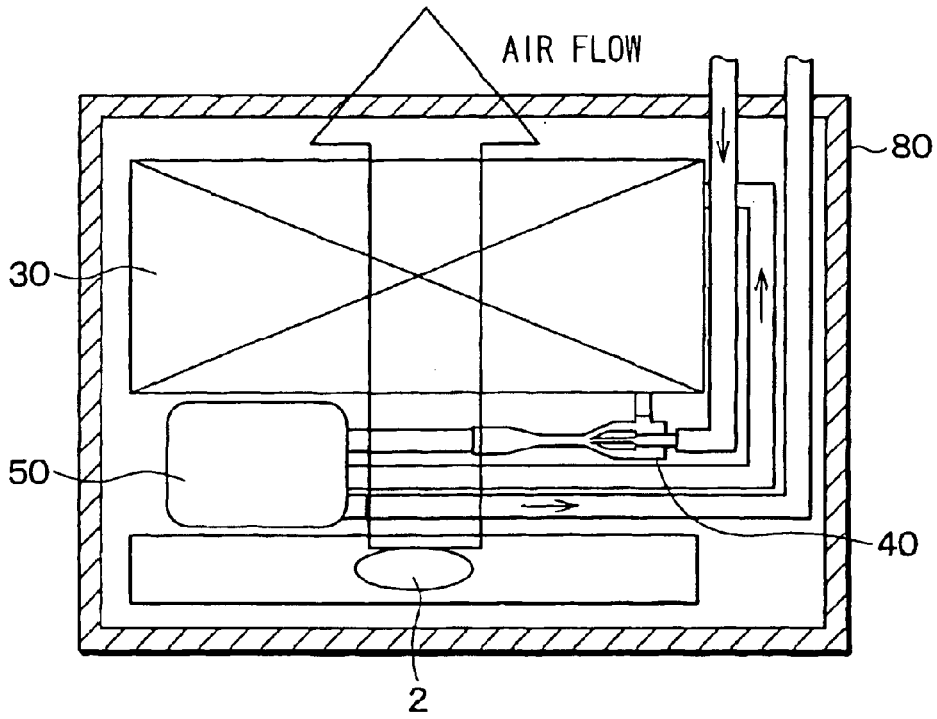
FIG. 5 is a schematic view showing a modification of the cooling unit.

In the above embodiments, the ejector 40 and the gas-liquid separator 50 are arranged downstream of the evaporator 30 in the air flow. However, the present invention is not limited to this. For example, as shown in FIG. 5, at least one of the ejector 40 and the gas-liquid separator 50 can be arranged upstream of the evaporator 30 in the air flow.

In the above embodiment, the entire ejector 40 is received in the casing 80. However, since the refrigerant temperature at the inlet of the nozzle arrangement 41 is relatively high, it is possible to arrange only the pressurizer arrangement of the ejector 40 in the casing 80.

In the above embodiments, chlorofluorocarbon is used as the refrigerant to maintain the refrigerant pressure at the high pressure side below the critical pressure. However, the present invention is not limited to this. For example, carbon dioxide can be used as the refrigerant, and the refrigerant pressure at the high pressure side can be made equal to or greater than the critical pressure of the refrigerant.

In the above embodiments, the ejector 40 and the gas-liquid separator 50 are arranged in the air flow generated by the blower 2. However, the present invention is not limited to this arrangement.

In the above embodiments, the present invention is embodied in the showcase, which stores food under refrigeration. However, the present invention is not limited to this and can be applied to any other suitable apparatuses.

Additional advantages and modifications will readily occur to those skilled in the art. The invention in its broader terms is therefore not limited to the specific details, representative apparatus, and illustrative examples shown and described.

What is claimed is:

1. A vapor compression refrigeration system that transfers heat from a low temperature side to a high temperature side, the vapor compression refrigeration system comprising:

a compressor that draws and compresses refrigerant;

a high pressure side heat exchanger that releases heat from high pressure refrigerant discharged from the compressor;

a low pressure side heat exchanger that vaporizes low pressure refrigerant;

an ejector that increases intake pressure of the compressor and includes:

a nozzle arrangement that depressurizes and expands high pressure refrigerant supplied from the high pressure side heat exchanger; and a pressurizer arrangement that draws vapor phase refrigerant, which is vaporized in the low pressure side heat exchanger, through use of high speed refrigerant flow discharged from the nozzle arrangement and converts expansion energy of the refrigerant discharged from the nozzle arrangement into pressure energy; and a gas-liquid separating means for separating the refrigerant discharged from the ejector into vapor phase refrigerant and liquid phase refrigerant, wherein:

the gas-liquid separating means has a vapor phase refrigerant outlet for outputting the vapor phase refrigerant and a liquid phase refrigerant outlet for outputting the liquid phase refrigerant, and the vapor phase refrigerant outlet and the liquid phase refrigerant outlet of the gas-liquid separating means are connected to a refrigerant inlet of the compressor and a refrigerant inlet of the low pressure side heat exchanger, respectively; and at least the gas-liquid separating means and the low pressure side heat exchanger are arranged in a common casing.

2. A vapor compression refrigeration system according to claim 1, wherein at least a portion of the ejector is arranged in the casing.

3. A vapor compression refrigeration system according to claim 2, further comprising a blower that blows air toward the low pressure side heat exchanger, wherein the portion of the ejector, which is arranged in the casing, is placed in an air flow generated by the blower.

4. A vapor compression refrigeration system according to claim 1, wherein at least the pressurizer arrangement of the ejector is arranged in the casing.

5. A vapor compression refrigeration system according to claim 1, further comprising a blower that blows air toward the low pressure side heat exchanger, wherein the gas-liquid separating means is disposed in an air flow generated by the blower.

6. A vapor compression refrigeration system according to claim 4, wherein the gas-liquid separating means is located downstream of the low pressure side heat exchanger in the air flow generated by the blower.

7. A vapor compression refrigeration system according to claim 1, pressure loss, which occurs in a refrigerant passage from a refrigerant outlet of the ejector to a refrigerant inlet of the ejector through the gas-liquid separating means and the low pressure side heat exchanger, is set to a level smaller than an amount of pressure increase in the pressurizer arrangement.

8. A vapor compression refrigeration system according to claim 1, wherein the low pressure side heat exchanger, the ejector and the gas-liquid separating means are integrated together.

9. A vapor compression refrigeration system according to claim 1, wherein the vapor compression refrigeration system is operated such that the temperature in the low pressure side heat exchanger is kept equal to or below zero degrees Celsius.

* * * * *